US007014061B2

(12) United States Patent
Hoffbauer

(10) Patent No.: US 7,014,061 B2
(45) Date of Patent: Mar. 21, 2006

(54) GLASS RECEPTACLE FOR HOUSEHOLD USE

(75) Inventor: Bernd Hoffbauer, Herne (DE)

(73) Assignee: Herner Glas Bernd Hoffbauer GmbH & Co. Leuchten und Industrieglas KG, Herne (DE)

( * ) Notice: Subject to any disclaimer, the term of this patent is extended or adjusted under 35 U.S.C. 154(b) by 71 days.

(21) Appl. No.: 10/443,119

(22) Filed: May 21, 2003

(65) Prior Publication Data

US 2003/0226849 A1 Dec. 11, 2003

(30) Foreign Application Priority Data

Jun. 7, 2002 (DE) ..... 102 25 590
May 13, 2003 (DE) ..... 103 21 650
May 15, 2003 (DE) ..... 103 22 065

(51) Int. Cl.
*B65D 1/40* (2006.01)
*F21V 33/00* (2006.01)

(52) U.S. Cl. ..... 220/662; 206/457; 40/553; 40/626; 40/630; 362/253; 362/311; 362/339; 362/350; 362/355; 362/363; 362/412; 362/806

(58) Field of Classification Search ..... 220/62.12, 220/662, 663, 574; 206/457; 40/310, 324, 40/553, 554, 626, 627, 630; 362/104, 253, 362/311, 339, 350, 351, 355, 356, 363, 367, 362/410, 412, 414, 571, 806
See application file for complete search history.

(56) References Cited

U.S. PATENT DOCUMENTS 2,533,578 A * 12/1950 Gomersall ..... 220/663
2,596,965 A * 5/1952 Troy ..... 2/239
5,275,277 A * 1/1994 Gallegos ..... 206/217

FOREIGN PATENT DOCUMENTS

DE 2 115 089 10/1972
DE 199 34 609 1/2001
JP 11-99009 * 4/1999

* cited by examiner

*Primary Examiner*—Stephen K. Cronin
(74) *Attorney, Agent, or Firm*—Herbert Dubno; Andrew Wilford

(57) ABSTRACT

A household-use receptacle has a one-piece glass body having a side wall forming an annular upper edge defining an upwardly open mouth and having an inner surface and an outer surface and a floor unitarily joined to a lower edge of the side wall and forming with the side wall an upwardly open and laterally closed interior. The side wall is formed with at least one horizontally throughgoing hole having an annular inner edge. A decorative jewel is fixedly secured in the hole and projects horizontally past one of the side-wall surfaces.

14 Claims, 4 Drawing Sheets

FIG.4B
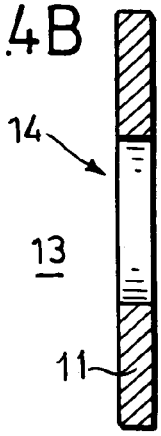
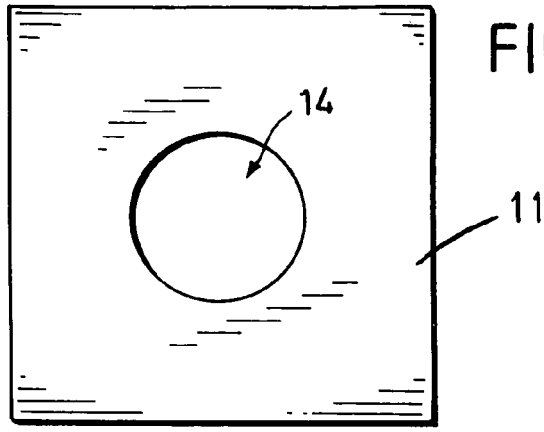
FIG.4 A
FIG.5B
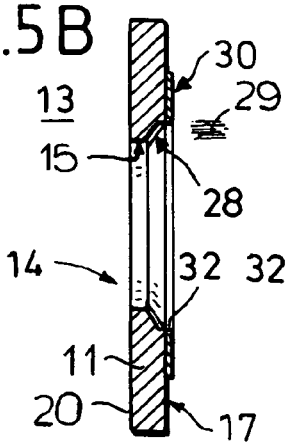
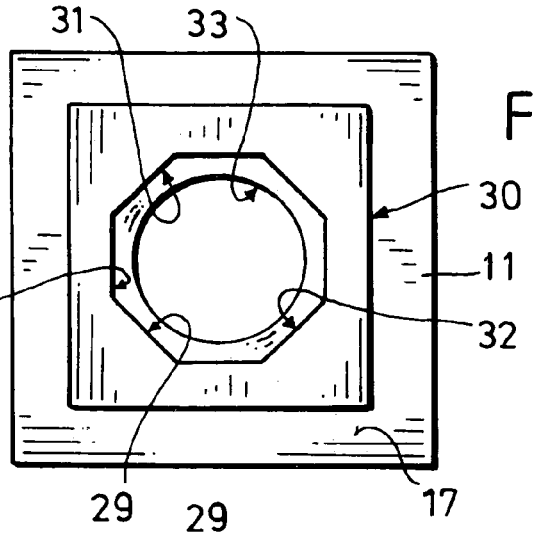
FIG.5A
FIG.6B
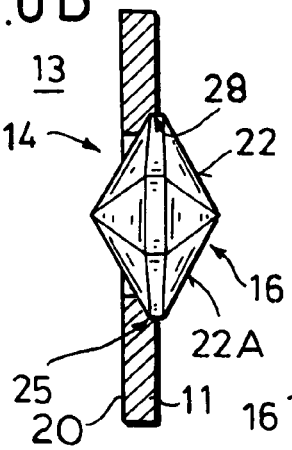
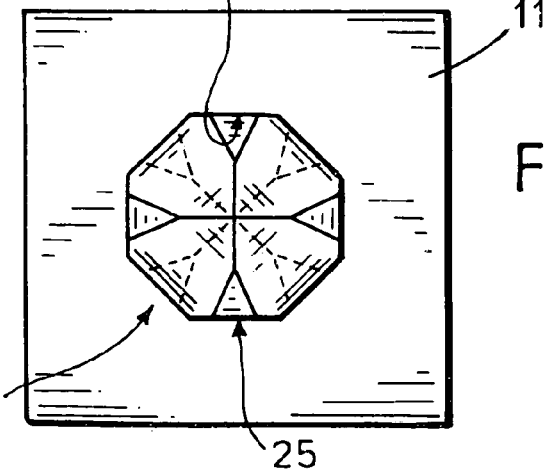
FIG.6A

GLASS RECEPTACLE FOR HOUSEHOLD USE

FIELD OF THE INVENTION

The present invention relates to a glass receptacle. More particularly this invention concerns such a receptacle suitable for household use as, for example, a vase, salad bowl. Baking dish, or the like.

BACKGROUND OF THE INVENTION

A standard glass receptacle of the above-mentioned type for household use has a side wall with an annular upper edge forming an upwardly open mouth and an annular lower edge joined unitarily with an outer periphery of a floor. The side wall and floor are unitarily formed with each other and together form an interior adapted to contain something.

For decorative purposes it is known to etch, grind, or otherwise mark the exterior of the side wall. It is also possible to form undercuts on the exterior of the side wall during the original molding process that makes the receptacle. Demolding such a receptacle formed with exterior recesses or undercuts that do not extend to the mouth is fairly difficult, requiring the use of an expensive multipart mold.

German patent document 199 34 609 of G. Hermann and J. Hein describes a household-use receptacle, in this case a drinking glass, whose floor is formed, as is standard, with a downwardly open pocket. In order to prevent this pocket from filling with liquid, for instance soapy water when the glass is stood upside-down in a dishwasher, a plug of plastic is molded inside the pocket and completely fills it. Although this plastic plug has some decorative effect, it is largely unseen, in particular if the glass is filled with an opaque substance.

In wholly nonanalogous art epitomized by German patent document 2,115,089 of W. Seekircher and H. Goedderz a downwardly open and opaque cup-shaped body of fired clay has a side wall formed with a plurality of throughgoing slots in which jewels are set. Such a structure could not be used as a household receptacle and is not really relevant to the instant invention.

OBJECTS OF THE INVENTION

It is therefore an object of the present invention to provide an improved glass receptacle for household use, e.g. as a vase, salad bowl, or baking dish.

Another object is the provision of such an improved glass receptacle for household use, e.g. as a vase, salad bowl, or baking dish which overcomes the above-given disadvantages, that is which is of simple and inexpensive construction yet which is very attractive.

SUMMARY OF THE INVENTION

A household-use receptacle has according to the invention a one-piece glass body having a side wall forming an annular upper edge defining an upwardly open mouth and having an inner surface and an outer surface and a floor unitarily joined to a lower edge of the side wall and forming with the side wall an upwardly open and laterally closed interior. The side wall is formed with at least one horizontally throughgoing hole having an annular inner edge. A decorative faceted jewel is fixedly secured in the hole and projects horizontally past one of the side-wall surfaces.

Such a structure can be made by machines, that is it does not require expensive hand-working artisans for its manufacture. The jewel, which according to the invention is made of glass like the receptacle, but may be of a different color or finish to achieve the desired decorative effect, is easily mounted in the hole and forms an integral piece of the receptacle. It can even seal tightly to make the receptacle suitable for holding water. The jewel can be any decorative body, normally solid, that can be secured to the glass wall of the receptacle.

According to the invention the jewel has an outer edge projecting past the inner edge of the hole. This makes it particularly easy to mount in place, and eliminates the need to finish the edge of the hole.

In accordance with the invention the jewel has an outer edge set in the hole. More particularly, the jewel outer edge is spaced from the hole inner edge. In this case it is mounted in place by at least one hanger engaged with the side wall and with the jewel. With this arrangement the hole need merely be somewhat larger than the jewel, its size does not need to be set to an exact tolerance. Furthermore the jewel can have the ability to move somewhat, providing a nice decorative effect.

The jewel is secured according to the invention to the outer surface of the side wall, to which end it is somewhat bigger than the hole. Once again, with this structure the exact size of the hole is not critical, so long as it is somewhat smaller than the jewel. In this embodiment the jewel is secured in place by a ring of transparent adhesive. The jewel has an outer edge projecting past the hole inner edge and the ring of transparent adhesive is between the side-wall outer surface and the jewel.

The side wall according to the invention is at least partially transparent. In addition the floor is adapted to stand on a support surface. It can be formed with a foot, when for instance the receptacle is to be used as a freestanding vase. The jewel is generally transparent and is normally made of glass.

The hole according to the invention is generally circular and can be made by means of a simple grit-type glass drill. It is possible to cut a polygonal-section hole using a high-pressure liquid stream, but this method is somewhat more costly.

For best mounting of the jewel, the side wall is formed on one of the surfaces at the hole edge with a bevel against which the jewel is fitted. This one surface is the outer surface and the bevel tapers inward. In fact the bevel can be complementary to the jewel.

BRIEF DESCRIPTION OF THE DRAWING

The above and other objects, features, and advantages will become more readily apparent from the following description, reference being made to the accompanying drawing in which:

FIGS. 4A and 4B, 5A and 5B, and 6A and 6B are front and side-sectional views illustrating manufacture of the receptacle according to the invention.

SPECIFIC DESCRIPTION

Figure 1:
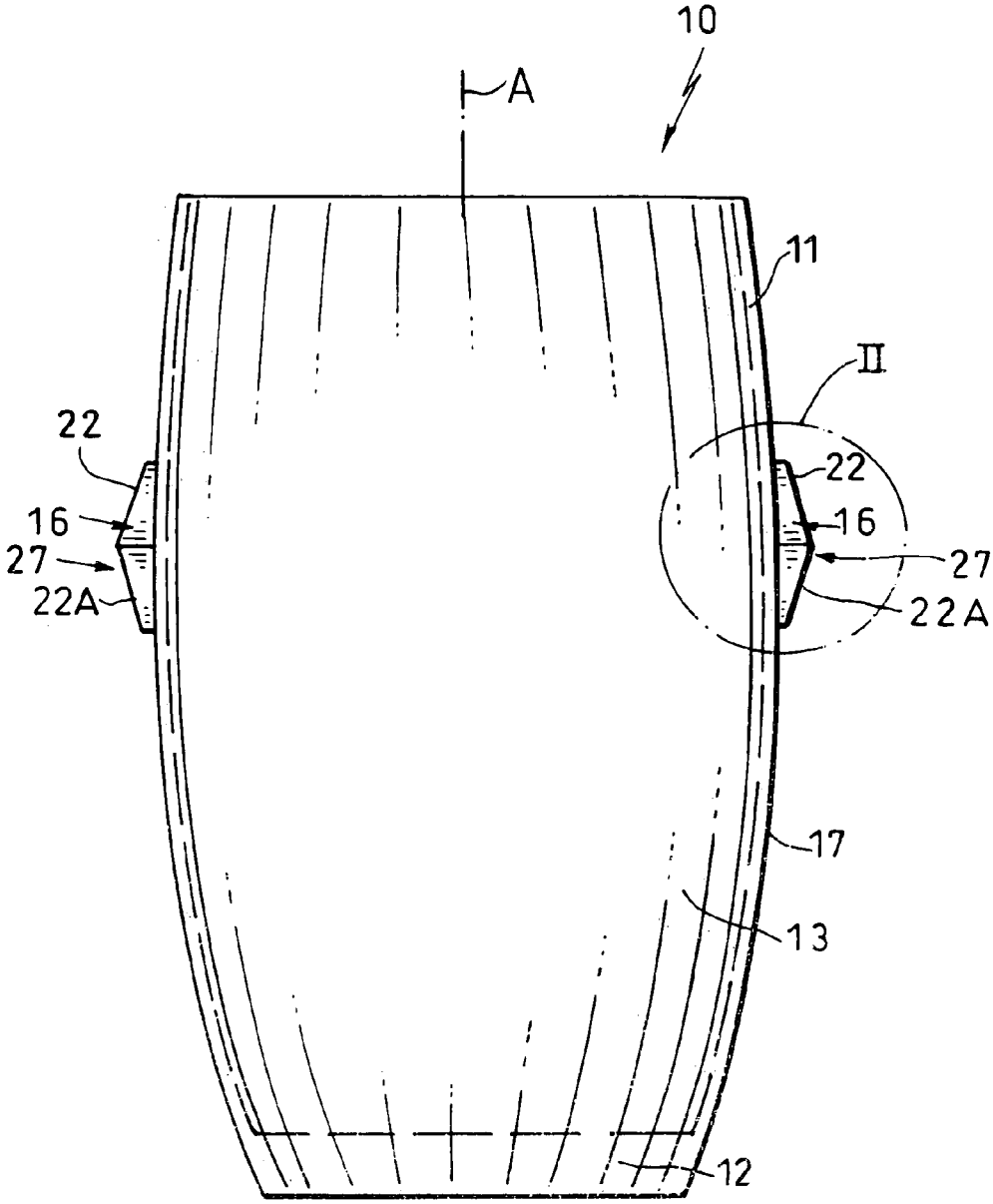
FIG. 1 is a side view of a household-use receptacle, here a vase, according to the invention.

As seen in FIG. 1 a receptacle, here a vase 10, according to the invention has a clear glass upright side wall 12 formed as a body of revolution centered on an upright axis A and having an upper edge 23 defining an upwardly open mouth and a lower edge joined unitarily to a planar floor or base 12 adapted to sit flatly on a support surface. This floor 2 can be extended as a foot. The wall 11 and floor 12 are molded or blown as one piece and define an upwardly open and laterally closed interior 13 and the wall 11 has an outside surface 17 and an inside surface 20 (FIG. 2).

Figure 2:
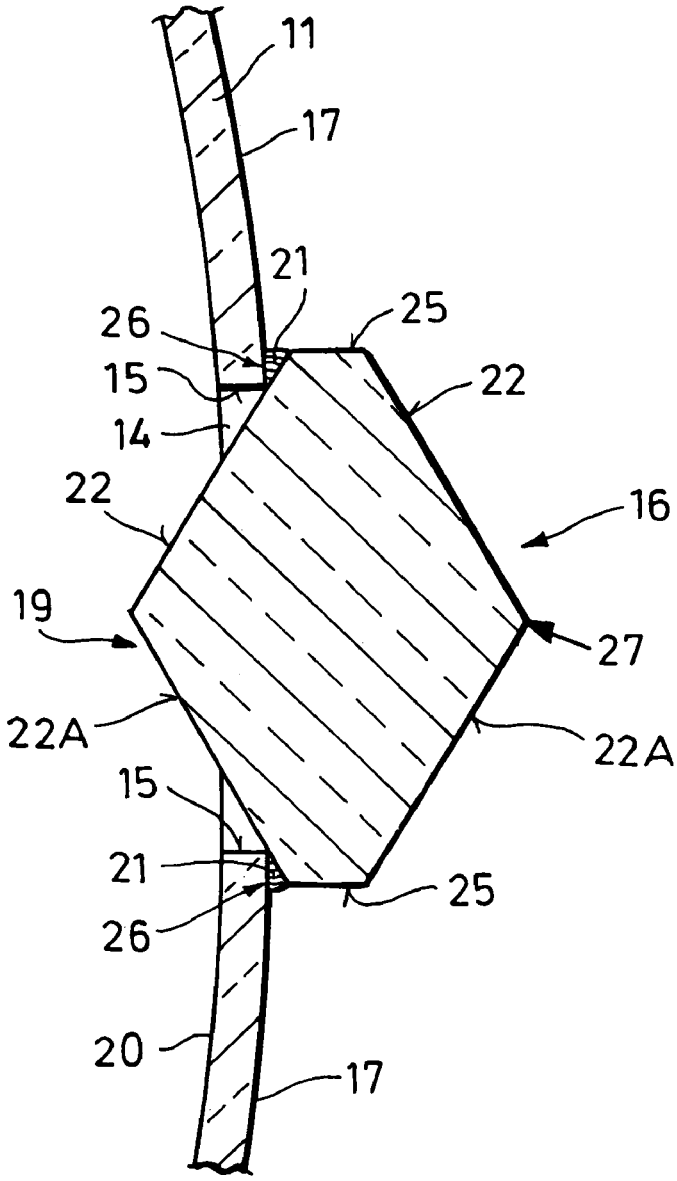
FIG. 2 is a large-scale sectional view of a detail of FIG. 1.

As better shown in FIG. 2 the wall 11 is formed offset from the upper edge 23 with a pair of circular and horizontally throughgoing holes 14 each having an inner edge 15. A glass jewel 16 is set from outside in each of these holes 14. The jewels 16 each have a plurality of planar facets 22 defining an inside point 19 that projects inward past the inside surface 20 and an outside point 27 and an outer edge 25 formed here by eight identical planar facets. In FIG. 2 the jewel 16 is of larger size than the hole 14 so that its edge 25 projects past the edge 15 and forms therewith an annular space 26 which is filled with a ring 21 of clear adhesive securing the jewel 16 in place.

Figure 3:
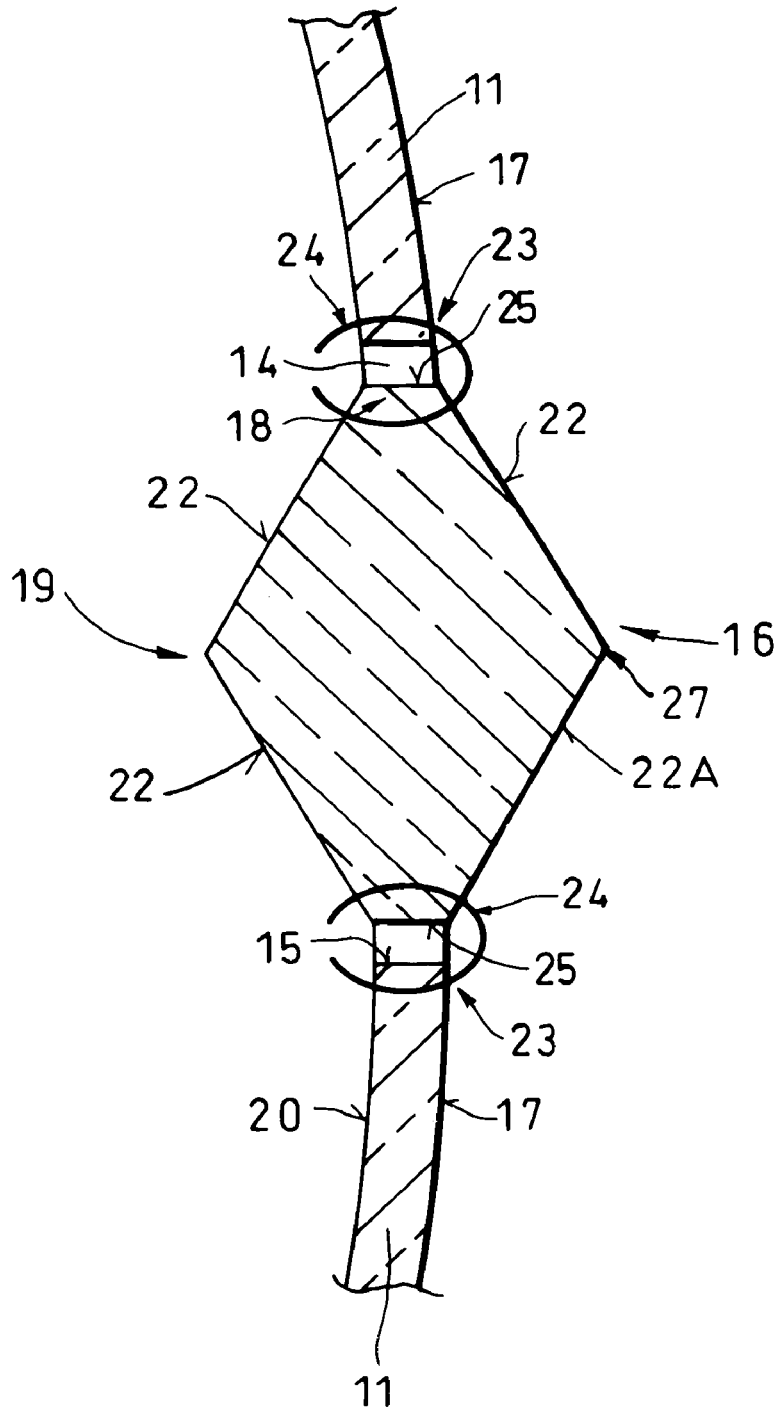
FIG. 3 is a view like FIG. 2 of another embodiment of the invention.

In FIG. 3 the jewel 16 is of smaller size than the circular hole 14 so that it can fit wholly therein and define therewith an annular gap 25. Here the means securing the jewel 16 in the hole 14 is a plurality of wire hangers 24 each poked through an unillustrated hole near the edge 25 of the jewel 16 and a respective unillustrated hole near the edge 15 of the hole 14.

FIGS. 4A through 6B show how a jewel 16 as in FIG. 2 is mounted. To start with as shown in FIGS. 4A and 4B the circular hole 14 is bored by an appropriate carbide bit.

Then as shown in FIGS. 5A and 5B a polyvinyl chloride mask 30 is adhered to the outside surface around the hole 14. This mask 30 is formed with a hexagonal hole 31 somewhat larger than the hole 14 so that the outside surface 17 is exposed at an annular region 32 between the edge of the hole 31 and the edge 15 of the hole 14. A jet 29 of quartz sand or carbide particles is then directed at the exposed region 32 to form a bevel 28 that is tapered to a point inward of the inner surface 20.

Finally as shown in FIGS. 6A and 6B the jewel 16 is seated against this bevel 28 and secured in place by a ring 26 of adhesive as in FIG. 2. Here the jewel 16 is dimensioned such that, when thus seated in the bevel 28, the plane of the outer surface 17 bisects the edge 25 and the jewel 16.

I claim:

1. A household-use receptacle comprising:

a one-piece molded or blown glass body having an at least partially transparent side wall forming an annular upper edge defining an upwardly open mouth and having an inner surface and an outer surface, and a floor unitarily joined to a lower edge of the side wall and forming with the side wall an upwardly open and laterally closed interior, the side wall being formed with at least one horizontally throughgoing hole having an annular inner edge;

a decorative faceted generally transparent jewel set in the hole and projecting horizontally past one of the side-wall surfaces; and means fixedly securing the jewel in the hole.

2. The household-use receptacle defined in claim 1 wherein the jewel has an outer edge projecting past the inner edge of the hole.

3. The household-use receptacle defined in claim 1 wherein the means secures the jewel to the outer surface of the side wall.

4. The household-use receptacle defined in claim 1 wherein the floor is adapted to stand on a support surface.

5. The household-use receptacle defined in claim 1 wherein the jewel is of glass.

6. The household-use receptacle defined in claim 1 wherein the hole is generally circular.

7. The household-use receptacle defined in claim 1 wherein the means is a ring of transparent adhesive.

8. The household-use receptacle defined in claim 7 wherein the jewel has an outer edge projecting past the hole inner edge and the ring of transparent adhesive is between the side-wall outer surface and the jewel.

9. The household-use receptacle defined in claim 1 wherein the jewel has an outer edge set in the hole.

10. The household-use receptacle defined in claim 9 wherein the jewel outer edge is spaced from the hole inner edge.

11. The household-use receptacle defined in claim 10 wherein the means includes at least one hanger engaged with the side wall and with the jewel.

12. A household-use receptacle comprising:

a one-piece molded or blown glass body having an at least partially transparent side wall forming an annular upper edge defining an upwardly open mouth and having an inner surface and an outer surface, and a floor unitarily joined to a lower edge of the side wall and forming with the side wall an upwardly open and laterally closed interior, the side wall being formed with at least one horizontally throughgoing hole having an annular inner edge;

a decorative faceted generally transparent jewel set in the hole and projecting horizontally past one of the side-wall surfaces; and means fixedly securing the jewel in the hole, the side wall being formed on one of the surfaces at the hole edge with a bevel against which the jewel is fitted.

13. The household-use receptacle defined in claim 12 wherein the one surface is the outer surface and the bevel tapers inward.

14. The household-use receptacle defined in claim 12 wherein the bevel is complementary to the jewel.

* * * * *